US009924844B1

(12) United States Patent
Person et al.

(10) Patent No.: US 9,924,844 B1
(45) Date of Patent: Mar. 27, 2018

(54) FLOOR SCRUBBER DRY SWEEP APPARATUS

(71) Applicant: Minuteman International, Inc., Hampshire, IL (US)

(72) Inventors: Barry M. Person, Carthage, NC (US); Kevin P. Sheehan, Aberdeen, NC (US); Christopher M. Knowlton, Pinehurst, NC (US)

(73) Assignee: MINUTEMAN INTERNATIONAL, INC., Hampshire, IL (US)

( * ) Notice: Subject to any disclaimer, the term of this patent is extended or adjusted under 35 U.S.C. 154(b) by 0 days.

(21) Appl. No.: 15/379,805

(22) Filed: Dec. 15, 2016

(51) Int. Cl.

| | |
|---|---|
| ***A47L 11/29*** | (2006.01) |
| ***A47L 11/30*** | (2006.01) |
| ***A47L 11/40*** | (2006.01) |
| ***A47L 11/24*** | (2006.01) |

(52) U.S. Cl.
CPC ..... *A47L 11/302* (2013.01); *A47L 11/24* (2013.01); *A47L 11/4016* (2013.01); *A47L 11/4041* (2013.01); *A47L 11/4044* (2013.01); *A47L 11/4083* (2013.01); *A47L 11/4088* (2013.01)

(58) Field of Classification Search
CPC ..... A47L 11/302; A47L 11/4013; A47L 11/4016; A47L 11/4044; A47L 11/4088; A47L 11/29
USPC ..... 15/340.1, 340.3, 340.4
See application file for complete search history.

(56) References Cited

U.S. PATENT DOCUMENTS

| | | | | |
|---|---|---|---|---|
| 4,819,676 | A | 4/1989 | Blehert et al. | |
| 5,093,955 | A | 3/1992 | Blehert et al. | |
| 6,662,402 | B2 | 12/2003 | Giddings et al. | |
| 7,272,870 | B2 | 9/2007 | Pierce et al. | |
| 7,805,802 | B2 * | 10/2010 | Shinler | A47L 11/4013 15/319 |
| 8,584,294 | B2 | 11/2013 | Loring | |

* cited by examiner

*Primary Examiner* — David Redding
(74) *Attorney, Agent, or Firm* — Greer Burns & Crain, LTD.

(57) ABSTRACT

An industrial floor scrubber includes a solution tank and delivery system for applying the solution to the floor, and one or more rotating brushes for removing dust and debris from the floor and respectively directing same to a squeegee and to a debris hopper. The trailing squeegee removes the remaining solution from the floor and, in combination with a vacuum system, directs the recovered solution to a cleaning solution recovery tank in the scrubbing mode of operation. In a sweeping mode of operation, the use of a dust filter is eliminated as the dust-laden air is directed past the debris hopper and onto the upraised squeegee which confines and directs the dust-laden air into a spray of fine water particles which adhere to and transport the dust-bearing water particles to the recovery tank via an applied vacuum. The heavy dust-bearing water particles drop into the recovery tank, while a demister removes the remaining water vapor with the dry air discharged to the atmosphere via a vacuum impeller.

22 Claims, 3 Drawing Sheets

FLOOR SCRUBBER DRY SWEEP APPARATUS

FIELD OF THE INVENTION

This invention relates generally to apparatus and a method for maintaining and conditioning a generally flat surface, and is particularly directed to the scrubbing and sweeping of a floor surface using a single apparatus which is easily converted between a wet scrubbing/sweeping mode of operation, and a dry sweeping operation without changing or replacing any components or systems.

BACKGROUND OF THE INVENTION

Industrial floor scrubbers typically include a cleaning solution tank, a solution delivery system to apply the cleaning solution to the floor in front of one or more rotating cylindrical or disc scrub brushes for cleaning the floor, a squeegee located aft of the scrub brushes for drying the floor, a vacuum system for reclaiming the cleaning solution, and a recovery tank for holding the reclaimed cleaning solution. In addition, floor scrubbers that employ cylindrical scrub brushes are frequently provided with a debris hopper located aft of the scrub brushes to catch wet debris swept from the floor by the typically counter-rotated scrub brushes. One advantage of this system is that it prevents debris from getting caught in the rear squeegee which would degrade drying of the floor by the squeegee.

Floor scrubber utility has recently been enhanced so as to provide the scrubber with a dry sweep capability, as opposed to merely scrubbing the floor using a water solution. To that end, dry sweep systems have been developed for use in some floor scrubbers. These dry sweep systems typically incorporate rubber skirts, or baffles, disposed around the perimeter of the floor engaging scrub brushes for the purpose of containing dust produced during the dry sweep operation. These modified floor scrubbers also sometimes include a dust filter mounted to an upper portion of a debris hopper, and a second separate vacuum impeller system to vacuum the debris hopper and draw the dust-laden air through the dust filter, as well as an intermittently operated filter shaker for shaking the filter clean. This system is very similar in operation to a standard dedicated floor sweeper.

Field use has demonstrated that there is a basic problem with this type of dry sweep system. When operating this type of machine as a floor scrubber, a large amount of water is swept, along with any collected debris, into the debris hopper. Most of this liquid is suctioned away from the debris hopper using a small vacuum hose that taps into a main rear squeegee vacuum hose. The dry sweep dust filter, even though not used when scrubbing and not transmitting air during scrubbing operations, becomes saturated and clogged with moisture and wet debris primarily due to its close proximity to the debris hopper. As a result, the saturated dry filter becomes ineffective when needed as a dry dust filter. It is then necessary for the operator to remove, wash, dry and replace the dust filter, or to replace the dust filter with a new filter before attempting to dry sweep.

Due to the relatively small debris hopper volume and other considerations, scrubbers used as dry sweepers are not intended to be as effective as a dedicated floor sweeper. If the floor environment is considered to be severe, or "out of control", due to the presence of large amounts of dust and/or debris, then the use of a dedicated floor sweeper is typically recommended to bring the environment under control before scrubbing or scrubber dry sweeping is attempted.

OBJECTS AND SUMMARY OF THE INVENTION

Accordingly, it is an object of the present invention to provide a combination floor scrubber and dry sweeper which eliminates the need for a dry filter for removing and confining dust recovered from the floor.

It is another object of the present invention to use a squeegee and vacuum arrangement in a combined floor scrubber and sweeper to direct, collect and confine dust removed from the floor during the sweeping operation in a solution recovery tank.

A further object of the present invention is to replace in a combined mobile floor sweeper and scrubber the use of a dry filter currently used to remove dust from the air flow in the sweeping mode of operation, and to eliminate the problems arising from the use of a water solution with a dry filter by using a water spray system, wherein the dust adheres to fine water particles which are directed into and confined within a solution recovery tank.

A still further object of the present invention is to position in a combined floor sweeper and scrubber apparatus a debris hopper for recovering floor debris in a manner which prevents (1) debris from getting caught in a rear squeegee, and (2) degradation in the floor cleaning and drying process.

Yet another object of the present invention is to increase mobile machine floor sweeping reliability and efficiency by reducing operation interruptions and the extent of required servicing arising from the use of a dry dust filter in a water usage and wet debris environment.

Still another object of the present invention is to provide an integrated dual mode floor scrubber and dry sweeper capable of operating in either mode as a scrubber/sweeper, or solely as a dry sweeper, where operating mode changes are accomplished without adding to or removing any components from the floor scrubber and sweeper.

The present invention incorporates various improvements in combined wet floor scrubber and drysweeper machines which removes and stores dust and debris removed from the floor using a solution application system and a squeegee arrangement for removing dust and recovering used solution from the floor and eliminating problems associated with the use of a dry dust filter with a solution applied to, and recovered from, the floor. Plural flexible skirts, or baffles, are positioned around the periphery of a scrub head having a pair of closely spaced, counter-rotating scrub brushes to confine and channel dust removed from the floor. The brushes direct dust and debris removed from the floor rearwardly and upwardly into a debris hopper as in the typical scrubbing operation. The dust is directed rearwardly by the skirts to a channel formed by a lower surface of the debris hopper and the floor, with the dust then directed to an aft squeegee disposed in a slightly raised position above the floor. Coupled to the squeegee is a generally vertical squeegee vacuum hose which is also coupled to a vacuum fan, or impeller, for drawing the dust upwardly to a solution recovery tank. Water in the form of a mist is directed onto the dust drawn upwardly through the squeegee vacuum hose, with the water particles adhering to and depositing the dust particles in the solution recovery tank. A demister disposed in, or adjacent to, an upper portion of the recovery tank separates the remaining water vapor from the air, and the dry air is drawn through the vacuum impeller for discharge from the scrubber/sweeper combination into the atmosphere.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
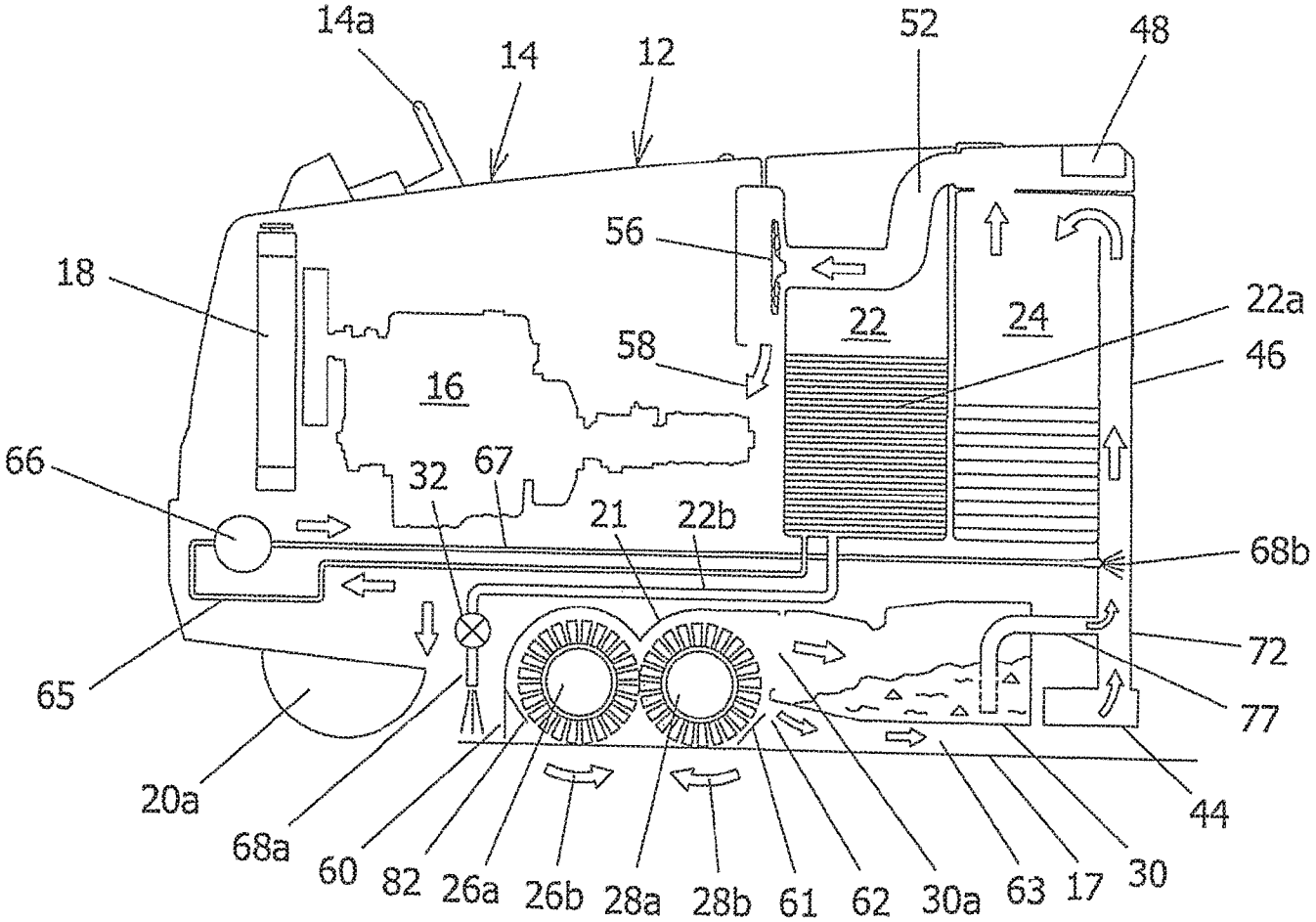
FIG. 1 is a simplified longitudinal sectional view taken along the length of the inventive floor scrubber dry sweep apparatus of the present invention.
Figure 2:
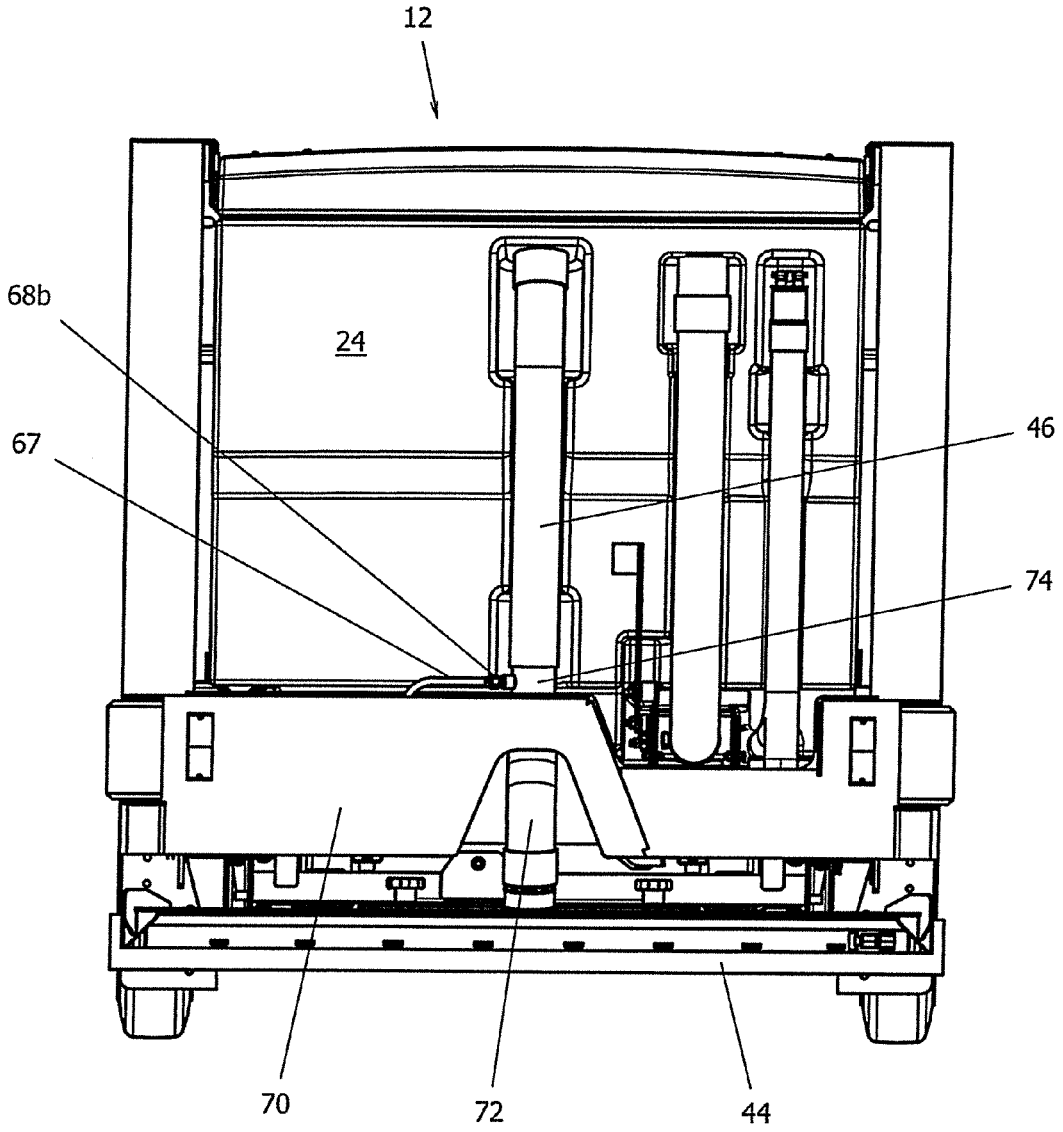
FIG. 2 is an aft, generally planar view of the inventive floor scrubber dry sweep apparatus.
Figure 3:
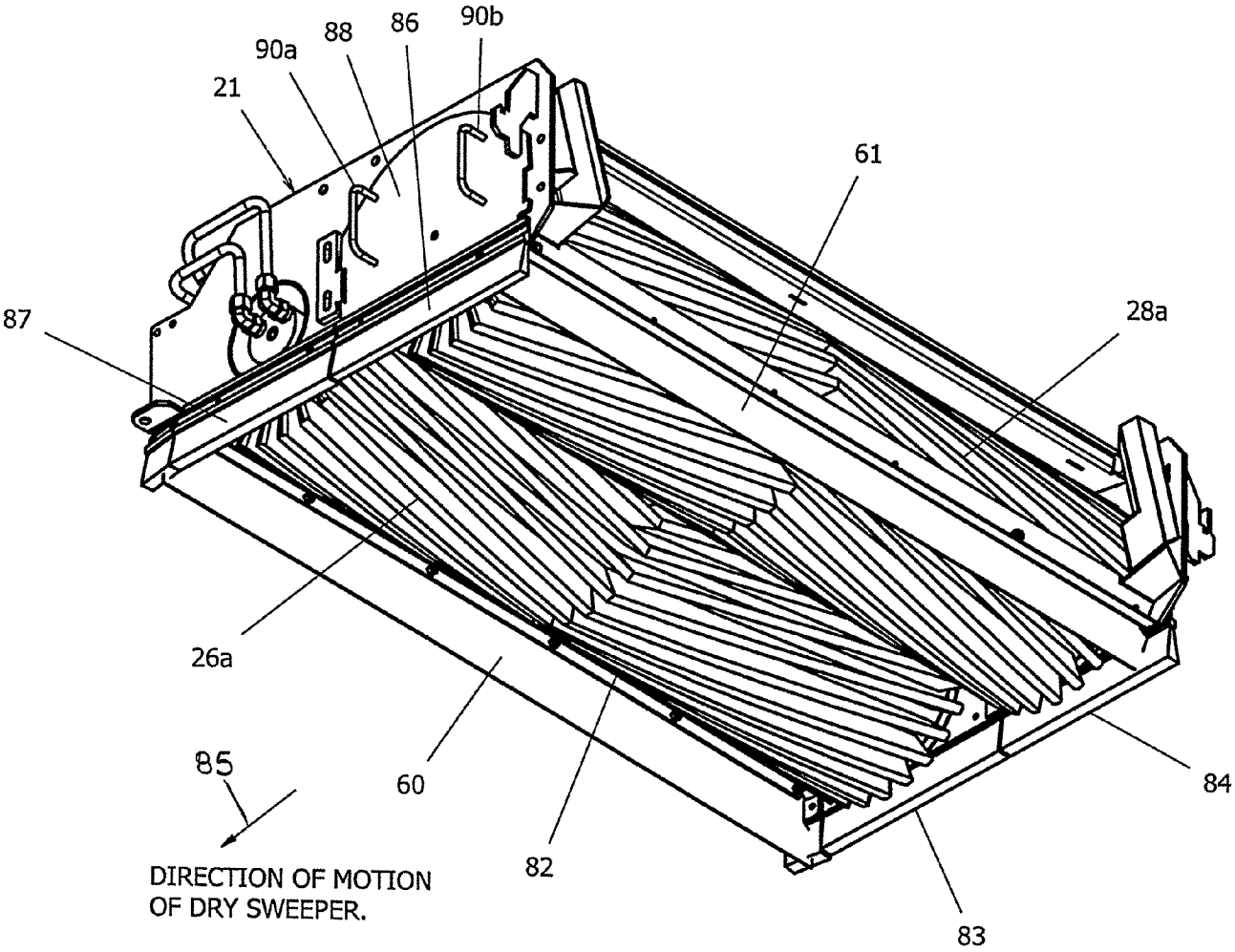
FIG. 3 is a perspective view of the bottom portion of a scrub head incorporated in the inventive floor scrubber and dry sweep apparatus which includes a pair of rotating cylindrical scrub brushes and a surrounding skirt arrangement for directing and confining the dust removed from the floor.

Referring to FIG. 1, there is shown a vertical cross sectional view of a combination floor sweeper and scrubber apparatus 12 in accordance with the present invention taken along the length of the apparatus. FIG. 2 is an aft, generally planar view of the inventive floor scrubber dry sweep apparatus 12, while FIG. 3 is a perspective view of a bottom portion of the apparatus illustrating a scrub head 21 including first forward and a second aft rotating scrub brushes 26*a* and 28*a*. The combination floor sweeper and scrubber apparatus 12 includes a chassis 14 which incorporates the various components and systems described in the following paragraphs. For example, the apparatus includes a steering wheel 14*a*, plural wheels, where one of the front wheels as shown as element 20*a* which is disposed upon and engages a floor 17. In addition, the combination floor sweeper and scrubber apparatus 12 further includes an engine 16 for displacing the floor sweeper and scrubber apparatus over the floor 17, as well as a radiator 18 coupled to the engine for controlling the engine's operating temperature.

Disposed in a lower portion of the floor sweeper and scrubber apparatus's chassis 14 is a scrub head 21 which includes a first forward cylindrical rotating scrub brush 26*a* and a second aft cylindrical rotating scrub brush 28*a*. Forward cylindrical scrub brush 26*a* rotates in the direction of arrow 26*b*, while the aft cylindrical scrub brush 28*a* counter-rotates in the direction of arrow 28*b*. The forward and aft cylindrical scrub brushes 26*a* and 26*a* are disposed in contact with the floor 17 and with one another so that the outer peripheral portions of their respective bristles are in contact with one another.

The inventive floor sweeper and scrubber apparatus 12 further includes a solution tank 22 containing a cleaning solution 22*a*. A solution delivery system is coupled to the solution tank 22 and includes a water pump 66 and a hose system for distributing the solution. More specifically, the solution distribution system includes a first hose section 22*b*, and second and third hose sections 65 and 67. When scrubbing, solution is delivered from the solution tank 22 via the first hose section 22*b* through a valve 32 to a first forward solution delivery tube 68*a* to a portion of the floor 17 immediately forward of the first cylindrical scrub brush 26*a*. When dry sweeping, the valve 32 is closed and by means of water pump 66, solution is provided from the solution tank 22 via the third hose section 67 to a second aft spray nozzle 68*b*.

Also disposed in a lower portion of the floor sweeper and scrubber apparatus 14 and aft of the scrub head 21 is a debris hopper 30. A forward, upper portion of the debris hopper 30 includes an aperture 30*a* which is adapted to receive debris removed from the floor 17 and displaced rearwardly by the forward and aft cylindrical scrub brushes 26*a* and 28*a*. When dry sweeping, dust removed from the floor 17 is displaced rearwardly by the forward and aft cylindrical scrub brushes 26*a*, 28*a* into a channel 63 defined by a lower portion of the debris hopper 30 and the floor 17. Rearward displacement of the dust causes the dust to engage a raised rear squeegee 44, which is preferably disposed approximately six inches above the floor 17. Squeegee 44 is coupled to the lower end of a rear squeegee vacuum hose 46, which is attached to an aft portion of the chassis 14 and is oriented generally vertically. An upper end of the rear squeegee vacuum hose 46 is coupled to an upper portion of a solution recovery tank 24. Also coupled to the upper end portion of the recovery tank 24 by means of an air duct 52 is a vacuum impeller, or fan, 56 for drawing clean dry air from the recovery tank 24 for discharge to the atmosphere.

When dry sweeping, the solution is directed via the second hose section 65 to water pump 66 which directs the water via the third hose section 67 to aft spray nozzle 68 coupled to the rear squeegee vacuum hose 46 for discharge of the cleaning solution in the form of water droplets onto the dust particles lifted by the vacuum impeller 56 within the rear squeegee vacuum hose in an upward direction. This fine water spray encapsulates the dust particles as they travel up the rear squeegee vacuum hose 46 and into the recovery tank 24. Within the recovery tank 24 most of the now wet dust particles are separated from the air flow within the recovery tank by gravity. Any remaining moisture is removed from the airflow by means of a demister 48 disposed within, or adjacent to, an upper portion of the recovery tank 24. The dry air is then drawn from recovery tank 24 via air duct 52 by the vacuum impeller 56 for discharge to the atmosphere. The rear squeegee vacuum hose 46 includes a lower vacuum hose 46*a* and an upper vacuum hose 46*b*.

The debris hopper 30 is coupled to a lower portion of the rear squeegee vacuum hose 46 via a suction hose 77. When scrubbing a partial vacuum created by the vacuum fan 56 draws moisture from the debris deposited with the debris hopper 30, with this withdrawn moisture then travelling up the rear squeegee vacuum hose 46 to recovery tank 24 for recovery of the used solution and separation of the dry air for discharge to the atmosphere via vacuum fan 56.

Referring to FIG. 2, there is shown an aft planar view of the floor sweeper and scrubber apparatus 12 of the present invention. A rear bumper 70 is disposed above the rear squeegee 44 and extends substantially the entire width of the inventive floor sweeper and scrubber apparatus 12, as does the rear squeegee 44. The lower rear squeegee vacuum hose 46*a* extends upwardly from the rear squeegee 44 and is attached to a vacuum hose manifold 74. Rear squeegee 44 is shown in the upraised dry sweep position. The lower end portion of the rear squeegee vacuum hose 46 is coupled to the rear squeegee 44, while the upper portion 46*b* of the rear squeegee vacuum hose is coupled to an upper portion of solution recovery tank 24. The vacuum hose manifold 74 is used to connect the upper and lower portions of the rear squeegee vacuum hose 46 as well as the suction hose 77 extending from an aft portion of the debris hopper 30 to the rear squeegee vacuum hose 46. Suction hose 77 provides recovered cleaning solution particles from the debris hopper 30 to the rear squeegee vacuum hose 46 for attachment to the dust particles traveling upward in the squeegee vacuum hose 46.

With reference also to FIG. 3, the operation and structure of the scrub head 21 which includes the forward and aft rotating scrub brushes 26*a* and 28*a* will now be described in detail. Forming respective left and right lateral portions of scrub head 21 are a left scrub head door 88 and a right scrub head door which is not shown in the figure for simplicity, where the scrub head travels in the direction of arrow 85 during operation. Attached to a lower portion of the left scrub head door 88 is a left side door skirt 86 and a left side skirt 87. Attached to adjacent lower portions of the right scrub head door is a right side door skirt 84 and a right side skirt 83. Each of the left and right scrub head doors includes a pair of handles 90*a* and 90*b* adapted for manual engagement so as to be able to open and close the attached scrub head door so as to provide access to the forward and aft cylindrical scrub brushes 26*a* and 28*a* for replacement of, or maintenance for, the two scrub brushes disposed within scrub head 21. Also disposed on the open lower portion of the scrub head 21 are a front dust skirt 60, a front recirculating skirt 82, and an aft dust recirculating skirt 61. The aforementioned skirts help to contain within the scrub head 21 dust removed from the floor 17 by the forward and aft cylindrical scrub brushes 26*a* and 28*a* during dry sweeping. The rotary motion of the two cylindrical brushes 26*a*, 28*b* tends to slightly pressurize the air within the scrub head 21 so that the dust-laden air directed rearwardly takes the path of least resistance in response to this pressure differential within the scrub head 21 and travels through the open space between the top of the aft dust recirculating skirt 61 and the front lower edge of the debris hopper 30 and then through channel 63. Channel 63 is formed by the lower portion of debris hopper 30 and floor 17 in conjunction with the side walls formed by the rear wheels (not shown) and their associated support structure (also not shown). Channel 63 extends substantially to the aft end of the floor sweeper and scrubber apparatus 12. The vacuum created by the vacuum impeller 56 draws the dust-laden air through channel 63 and raised squeegee 44, and then up through the rear squeegee vacuum hose 46.

Scrub head 21 further includes a generally rectangular frame coupled to and disposed about the forward and aft cylindrical scrub brushes 26*a* and 28*a*. Forward and aft cylindrical scrub brushes 26*a*, 28*a* are pivotally mounted within the scrub head 21 so as to freely rotate therein under the influence of a rotary drive system which is not shown in the figures for simplicity. Forming the right and left lateral portions of the scrub head 21 are left and right scrub head doors, where the left scrub head door is shown as element 88 in FIG. 3, and the right scrub head door is not shown in the figure for simplicity. As described above, front dust skirt 60 confines dust removed from the floor 17 within the scrub head 21 prior to its displacement into channel, or tunnel, 63 leading to the rear squeegee 44. Similarly, as also described above, the aft dust recirculating skirt 61 directs the dust so that it is discharged into the aforementioned channel 63 formed partially by floor 17. The front recirculating skirt 82 is also disposed immediately forward of the forward cylindrical scrub brush 26*a* for confining and directing the dust in a rearward direction as described above. Left and right side skirts 87 and 83 are respectively disposed on forward portions of the left side door skirt 86 and the right side door skirt (not shown). Each of the left and right scrub head doors includes a respective pair of handles 90*a* and 90*b* to facilitate pivotally displacing the left and right scrub head doors outwardly from the scrub head 21 to facilitate access to the forward and aft cylindrical scrub brushes 26*a* and 28*a*, as well as access to other system components within the scrub head 21.

During the dry sweeping mode of operation, floor debris is swept into the debris hopper 30 by the forward and aft cylindrical scrub brushes 26*a* and 28*a*. Dust-laden air is directed below the debris hopper 30 via channel 63, and is drawn via vacuum fan 56 into the cleaning solution recovery tank 24. Solution 22*a* from the solution tank 22 is sprayed into the rear squeegee vacuum hose 46 via aft spray nozzle 68*b*. The water spray particles encapsulate the dust removed from the floor 17 as the dust-laden air is drawn up within the rear squeegee vacuum hose 46 to the recovery tank 24. The resulting dirty solution, e.g., tap water, is then retained within the recovery tank 24 until discharged therefrom.

The floor sweeper and scrubber apparatus 12 incorporates an electrical system which interrupts power to a hydraulic solenoid valve that controls the raising and lowering of the rear squeegee 44 relative to floor 17 so that the squeegee remains raised during dry sweep operation of the inventive floor sweeper and scrubber apparatus 12. A dry sweep rocker switch is also used to interrupt power to the solution delivery solenoid valves to prevent water flow to the floor forward of the forward and aft cylindrical scrub brushes 26*a*, 28*a* also during the dry sweep mode of operation. Electrical power is applied to the dry sweep solution pump 66 for delivering water to the aft spray nozzle 68*b* attached to the rear squeegee vacuum hose 46. The electrical system interrupts delivery of electric power from a 3-position rotary switch to the scrub head floor pressure controller. The electrical controller then receives two "OFF" binary signals which activate the electrical controller for applying a "low floor pressure" signal to the scrub head 21. Application of the "low floor pressure" signal to the scrub head 21 prevents the operator from choosing the medium and heavy brush pressure settings when in the dry sweep mode of operation. The low floor pressure setting is preferred when dry floor sweeping. In addition, a "low solution" liquid level switch is wired so as to cut off dry sweep operation when the cleaning tank 22 is empty.

While particular embodiments of the present invention have been described, it will be obvious to those skilled in the relevant arts that changes and modifications may be made without departing from the invention in its broader aspects. Therefore, the aim in the appended claims is to cover all such changes and modifications that fall within the true spirit and scope of the invention. The matter set forth in the foregoing description and accompanying drawings is offered by way of illustration only and not as a limitation. The actual scope of the invention is intended to be defined in the following claims when viewed in their proper prospective based on the prior art.

The invention claimed is:

1. A combination floor sweeper and scrubber apparatus comprising:

plural rotating scrub brushes for engaging and cleaning the floor, including removing debris from the floor and displacing dust on the floor in a rearward direction relative to the direction of travel of the apparatus during operation;

a solution storage tank and delivery system for applying a cleaning solution to the floor;

a solution recovery tank;

a debris hopper disposed aft of said rotating scrub brushes and adapted to receive and store debris removed from the floor;

a squeegee disposed aft of said debris hopper, and in spaced relation to the floor;

an air displacement arrangement for drawing dust-laden air from said rotating scrub brushes past said debris tank and into engagement with said squeegee, said air displacement arrangement including a first elongated vacuum hose coupling said squeegee to said solution recovery tank; and a second elongated delivery hose coupling said solution storage tank to said first elongated vacuum hose for delivering fine water particles to the dust-laden air in said first elongated vacuum hose, wherein said fine water particles adhere to the dust particles for deposit in said solution recovery tank.

2. The combination floor sweeper and scrubber apparatus of claim 1, wherein said rotating scrub brushes are disposed within a substantially closed scrub head.

3. The combination floor sweeper and scrubber apparatus of claim 2, wherein said scrub head includes a substantially open lower portion adjacent the floor to provide floor contact for the scrub brushes.

4. The combination floor sweeper and scrubber apparatus of claim 3, wherein said scrub head includes plural skirts disposed adjacent the open lower portion thereof to restrain and direct the dust-laden air rearwardly into engagement with said squeegee.

5. The combination floor sweeper and scrubber apparatus of claim 4, wherein said plural skirts are disposed completely about the open lower portion of said scrub head.

6. The combination floor sweeper and scrubber apparatus of claim 4, wherein said skirts include a first front skirt for confining the debris within said scrub head prior to the scrub brushes directing the dust-laden air and debris rearwardly from said scrub head.

7. The combination floor sweeper and scrubber apparatus of claim 4, wherein said skirts include a second rear skirt for directing air-laden dust through a channel formed by the floor and a lower portion of said debris hopper.

8. The combination floor sweeper and scrubber apparatus of claim 3, wherein said scrub head further includes movable lateral panels to facilitate access to said cylindrical brushes for maintenance and/or replacement of said brushes.

9. The combination floor sweeper and scrubber apparatus of claim 2, wherein said rotating scrub brushes slightly pressurize the dust-laden air within said scrub head.

10. The combination floor sweeper and scrubber apparatus of claim 9, wherein the pressurized dust-laden air within said scrub head takes a path of least resistance in exiting the scrub head and passing between the top of a rear skirt disposed on said scrub head and front lower edge of said debris hopper.

11. The combination floor sweeper and scrubber apparatus of claim 10, wherein a space formed between said debris hopper, the floor and plural transport wheels mounted to said apparatus and their associated support structure form a channel for directing the dust-laden air from said scrub head to said squeegee.

12. The combination floor sweeper and scrubber apparatus of claim 1, wherein said plural scrub brushes include first and second closely spaced cylindrical brushes in counter-rotation.

13. The combination floor sweeper and scrubber apparatus of claim 12, wherein said first and second cylindrical brushes are aligned generally parallel with the floor and are disposed so as to displace dirt from the floor upwardly between the two brushes.

14. The combination floor sweeper and scrubber apparatus of claim 1, wherein said air displacement arrangement draws the dust-laden air aft from said rotating scrub brushes into a channel formed between the floor and a lower portion of said debris tank in the direction of said squeegee.

15. The combination floor sweeper and scrubber apparatus of claim 1 including first forward and second aft cylindrical scrub brushes in lengthwise mutual alignment and aligned generally transverse to the direction of travel of said apparatus during operation.

16. The combination floor sweeper and scrubber apparatus of claim 15, wherein said first and second cylindrical scrub brushes are counter-rotating with debris on the floor directed generally upward in a space disposed intermediate said first and second scrub brushes.

17. The combination floor sweeper and scrubber apparatus of claim 1 further comprising a water pump coupled to said solution storage tank and to said delivery system for distributing the solution throughout the floor sweeper and scrubber apparatus.

18. The combination floor sweeper and scrubber apparatus of claim 1, wherein said air displacement arrangement includes a vacuum impeller coupled to said recovery tank for drawing the dust-laden air and water droplets into said recovery tank, wherein said dust-laden water droplets are deposited in said recovery tank and dust-free dry air is drawn from said recovery tank for discharge to the atmosphere by said vacuum impeller.

19. The combination floor sweeper and scrubber apparatus of claim 1 further comprising a demister disposed within or adjacent to said cleaning solution recovery tank and coupled to said air displacement arrangement for removing moisture from the dust-laden air provided to said recovery tank and providing dry air to said vacuum impeller for discharge to the atmosphere.

20. The combination floor sweeper and scrubber apparatus of claim 1 further comprising a third suction hose coupling said debris hopper to said first elongated vacuum hose for removing moisture from debris provided to said debris hopper.

21. The combination floor sweeper and scrubber apparatus of claim 20, wherein said solution delivery system includes a fourth hose coupled to said solution storage tank for delivery of solution to the floor immediately forward of said plural rotating scrub brushes.

22. The combination floor sweeper and scrubber apparatus of claim 21, further comprising a fifth hose coupling said debris hopper to said first elongated vacuum hose for removal of moisture from said debris hopper.

* * * * *